United States Patent [19]

Bolin et al.

[11] Patent Number: 4,959,896

[45] Date of Patent: Oct. 2, 1990

[54] PROTECTION OF GAS ENGINE OR TURBINE FROM DAMAGE BY CHANGES IN OPERATING CHARACTERISTICS

[75] Inventors: William D. Bolin, Katy; Robert L. Roper, Longview, both of Tex.

[73] Assignee: Oryx Energy Company, Richardson, Tex.

[21] Appl. No.: 203,528

[22] Filed: May 23, 1988

Related U.S. Application Data

[63] Continuation of Ser. No. 3,441, Jan. 15, 1987.

[51] Int. Cl.[5] ..... F02D 29/06

[52] U.S. Cl. ..... 290/40 B

[58] Field of Search ..... 290/40 B; 322/27, 38

[56] References Cited

U.S. PATENT DOCUMENTS

| | | | |
|---|---|---|---|
| 2,359,886 | 10/1944 | Wikkenhauser | 290/40 B |
| 2,632,856 | 3/1953 | Dupy | 290/40 B |
| 3,701,556 | 10/1972 | Richmond | 290/40 B |
| 4,262,209 | 4/1981 | Berner | 290/40 B X |
| 4,459,490 | 7/1985 | Brandon | 290/40 B |
| 4,749,944 | 6/1988 | Okamoto | 322/27 X |

*Primary Examiner*—A. D. Pellinen
*Assistant Examiner*—W. E. Duncanson, Jr.
*Attorney, Agent, or Firm*—Claude E. Cooke, Jr.

[57] ABSTRACT

Apparatus and method are provided to protect a gas engine or turbine used to generate electric power against damage that would otherwise result from changes in the operating characteristics of the engine, for example, changes caused by fluctuation in the heat content of the gaseous fuel. To effect such protection, the engine or turbine is controlled by adjusting the supply of fuel gas to the engine or turbine in response to changes in the output of the electric power generated.

13 Claims, 2 Drawing Sheets

Figure 1:
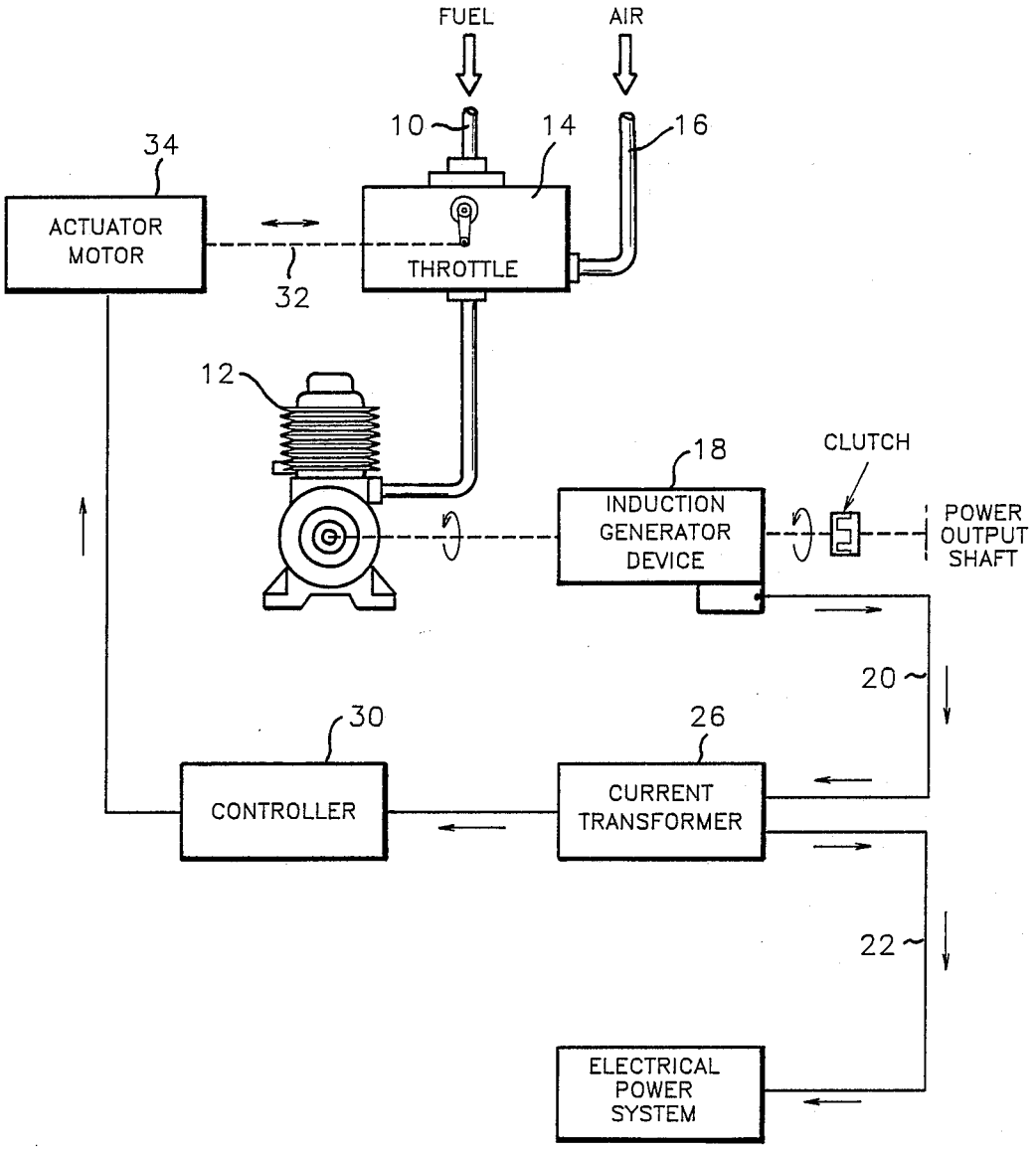

PROTECTION OF GAS ENGINE OR TURBINE FROM DAMAGE BY CHANGES IN OPERATING CHARACTERISTICS

This application is a continuation of application Ser. No. 003,441, filed Jan. 15, 1987.

This invention relates to systems in which hydrocarbons are used as fuel in engines which produce electrical energy. In some cases, for example, where the hydrocarbon gases are natural gases as produced from gas wells, the characteristics of the gas, e.g. temperature, hydrocarbon composition, heat content, moisture content and the like, are subject to change, and these changes may adversely affect the operation of the engine. For example, an increase in heat content may result in release of a greater amount of energy when the gas is burned in the engine, with a resultant increase in internal operating temperature of the engine. If these conditions continue unchecked, the engine may be damaged.

In accordance with the invention, such conditions are counteracted by measures which, in response to a change, for example, in the heat content of the gas, adjust the rate of gas intake to the engine, and adjust the engine load to maintain it within a desired range. In this sense, the invention acts as a governor for the engine, but acts in a manner more sensitive than conventional governors, enabling a desired condition to be maintained in cases where conventional speed governors are not sufficiently sensitive to the changes involved.

The present invention provides apparatus and method for producing electric power using an engine operating on gaseous fuel, with control of output horsepower of the engine to compensate for changes in the operation of the engine resulting from changes in the properties of engine performance and gaseous fuel. The apparatus according to the invention comprises combustion means for burning gaseous fuel; engine means powered by combustion products from the combustion means; throttle means for adjusting the relative amounts of gaseous fuel and oxygen-containing gas admitted to the combustion means; generator means powered by the engine means; and control means responsive to the current produced by the generator means for adjusting the throttle means to decrease the amount of fuel admitted when the horsepower output increases, and to increase the amount of fuel admitted when the horsepower output decreases.

In one embodiment of the apparatus according to the invention, a linear actuator motor is used to control the setting of the throttle means. Signals generated from the electrical output of the generator means control the longitudinal position of the shaft of the linear actuator motor, which in turn controls the size of the throttle aperture. Other known means of controlling aperture size by means of electrical signals may be employed.

The electrical control means according to the invention typically comprise an electrical set point, means for comparing the electrical output of the generator with the set point, means for decreasing the throttle aperture when the output voltage is above the set point, and means for increasing the throttle aperture when the electrical output is below the set point.

The method according to the invention comprises burning gaseous fuel in a combustion zone; driving an engine or turbine by the combustion products from the combustion zone; driving a generator by the engine or turbine; sensing the electrical output of the generator; comparing the electrical output to a voltage set point; decreasing the amount of gaseous fuel relative to oxygen in the feed to the combustion zone when the electrical output is above the set point and increasing the amount of gaseous fuel relative to oxygen in said feed when the electrical output is below the set point.

The apparatus and method according to the invention are applicable generally to engines powered by combustion products, including for example gas turbines as well as gas engines.

Figure 2:
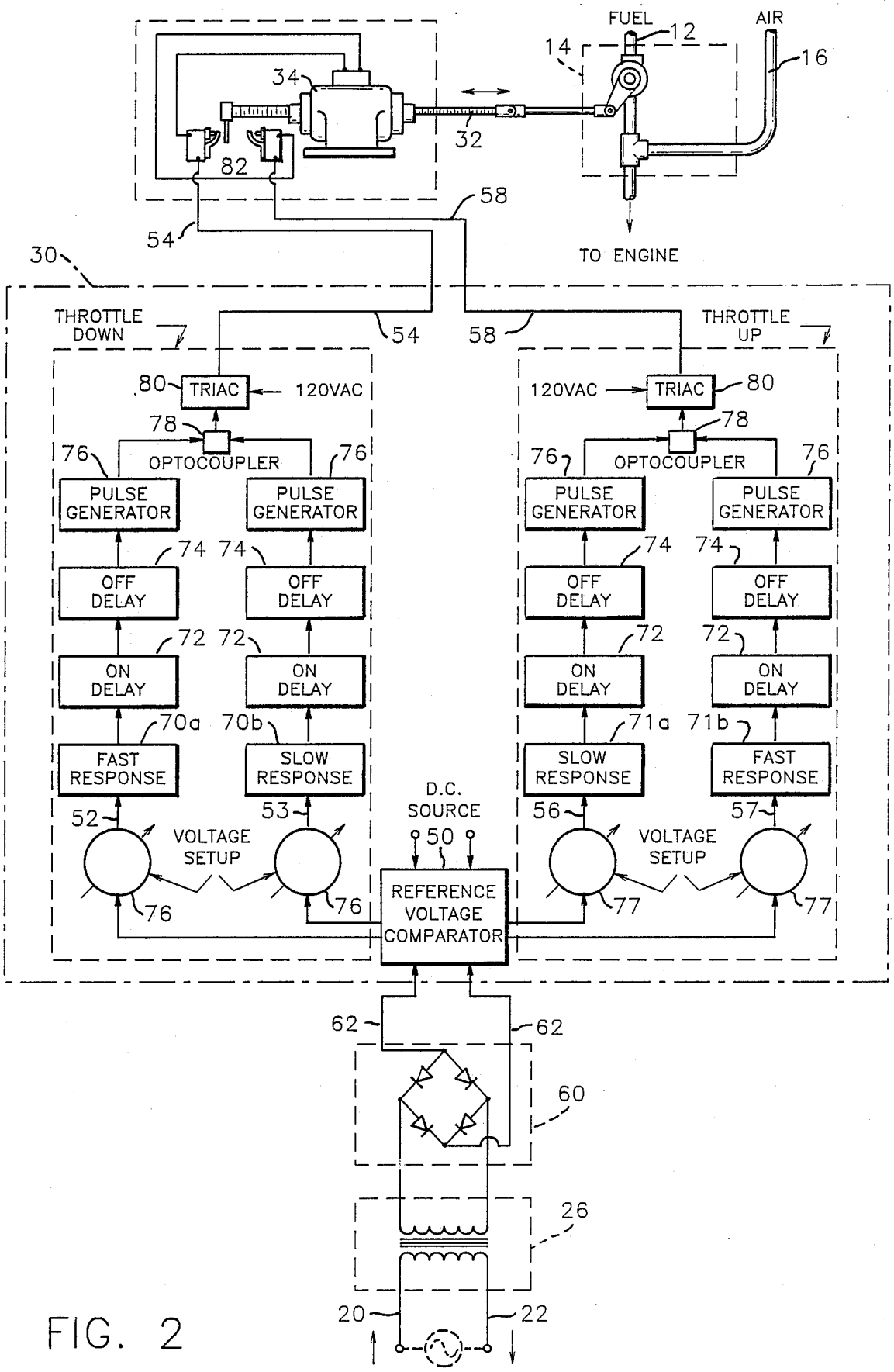

The invention will be further described with reference to the drawings, in which FIG. 1 is a schematic diagram illustrating the apparatus and method of the invention and FIG. 2 is a diagram of the electronic components of the controller used in the invention.

FIG. 1 illustrates the invention as applied to the use of natural gas from a gas lease to generate electric power at the lease site. Gas is introduced through line 10 into engine 12 by way of throttle 14. Air is also introduced into the engine 12 through line 16 by way of throttle 14, being drawn into the engine by suction of the engine piston. Fuel and air are burned in the engine and the power produced operates induction generator device 18.

Induction generator device 18 is capable of functioning as a motor when operating at lower speeds and as a generator when operating at higher speeds. Its function in this example is to generate electric power. The current produced is removed from machine 18 through electric wiring 20 and delivered to electrical system 23 through electric wiring 22.

In order to regulate the speed of the engine 12 and induction device 18, and prevent changes in the engine operation upon changes in the characteristics of the gas, current output from induction device 18 is passed through current transformer 26, and used in controller 30 to generate control signals which adjust the position of shaft 32 of linear actuator motor 34. The longitudinal position of shaft 32 adjusts the aperture of throttle 14.

Referring to FIG. 2, the voltage from current transformer 26 is converted to DC voltage in rectifier 60, then passed through lines 62 and compared with a reference voltage in reference voltage comparator 50. If the voltage is higher than the set point, signals passed through lines 52 or 53 and 54 cause the shaft 32 of the linear actuator motor 34 to move longitudinally to decrease the aperture of throttle 14 and reduce the rate of flow of fuel gas to engine 12 relative to the rate of flow of air. The speed of the engine 12 and the amperage output of induction device 18 are consequently reduced. If the output voltage is lower than the set point, signals passed through lines 56 or 57 and 58 cause the shaft 32 of the linear actuator motor 34 to move longitudinally to increase the aperture of throttle 14 and increase the rate of flow of fuel gas to engine 12 relative to the rate of flow of air. The speed of the engine 12 and the amperage output of induction device 18 are consequently increased.

Referring to FIG. 2 in more detail, the current from rectifier 60 is passed to adjustable DC voltage comparators 76 and 77 and compared against the reference voltage in comparator 50. Pulses are generated in response to the comparison and passed through adjustable electronic response timers 70*a*, 70*b*, 71*a* and 71*b*, the on-timers 72 and off-timers 74 to pulse generators 76, which through AC/DC isolating components (opticouplers) 78 and 120 volt alternating current electronic relays (Triacs) 80, operate linear actuator motor 34. On-timers 72 and off-timers 74 are adjustable electronic timers which are set to control the length of time that an on-condition or off-condition respectively lasts, in order to dampen resonant effects. In paths 52, 53 and 54, pulses generated in response to voltage above the set point turn on the linear actuator motor to reduce the throttle aperture. In path 52, where the voltage is farther above the set point than in path 53, the motor is turned on for longer increments of time than in path 53. Similarly in path 57, where the voltage is farther below the set point than in path 56, the motor is turned on to increase the throttle aperture for longer increments of time than in path 56.

The amperage output of an induction machine, in an operation according to the invention, with the engine load constant at about 120 hp, over a 23½ hour period beginning at 1:30 pm, with several changes during the period from wet gas (1700 BTU content) to dry gas (1050 BTU content), was maintained at about 70 amperes, with the engine throttle being moved during the period from about ¾ open to ¼ open automatically by the linear actuator motor.

The invention claimed is:

1. Apparatus for producing electrical power which comprises: combustion means for burning gaseous fuel; engine means powered by combustion products from said combustion means; throttle means for adjusting the relative amounts of gaseous fuel and oxygen-containing gas admitted to said combustion means; generator means powered by said engine means; and means for maintaining substantially constant current output from said generator, which means for maintaining comprise means for adjusting said throttle means to decrease the amount of fuel admitted to said combustion means when the current output from said generator increases, and to increase the amount of fuel admitted when said current output decreases.

2. Apparatus according to claim 1 wherein said combustion means and said engine means comprise a gas engine.

3. Apparatus according to claim 1 wherein said control means comprise a linear actuator motor comprising a shaft the longitudinal position of which controls the aperture of said throttle means.

4. Apparatus according to claim 1 wherein said means for maintaining comprise a current transformer, a voltage set point, means for comparing the output voltage of said current transformer with said voltage set point, and means for adjusting said throttle means to decrease the amount of fuel admitted to said combustion means when said output voltage is above the voltage set point, and for adjusting said throttle means to increase the amount of fuel admitted to said combustion means when said output voltage is above the voltage set point.

5. Apparatus according to claim 1 wherein said engine means are subject to substantially constant load.

6. Apparatus according to claim 1 wherein said generator is coupled to an existing electrical system.

7. Method for producing electrical power using a controlled speed engine or turbine which comprises: burning gaseous fuel in a combustion zone; driving an engine or turbine by the combustion products from said combustion zone; driving an electric generator by said engine or turbine; sensing the current output of said generator; decreasing the amount of gaseous fuel relative to oxygen in the feed to said combustion zone when said output increases and increasing the amount of gaseous fuel relative to oxygen in said feed when said output decreases.

8. Method according to claim 7 wherein the current output from said generator is maintained substantially constant by converting the same to voltage, by comparing the resulting voltage with a set point, and by said decreasing and increasing of the amount of gaseous fuel.

9. Method according to claim 7 wherein the engine or turbine performance changes from time to time, and the amount of gaseous fuel relative to oxygen in the feed to said combustion zone is adjusted in response to changes in said electrical output resulting from said changes.

10. Method according to claim 9 wherein said changes in performance result from changes in the heat content of the gaseous fuel to the engine or turbine.

11. Method according to claim 5 wherein the current output of said generator is maintained substantially constant by converting said current to voltage, comparing the resulting voltage with a voltage set point, decreasing the amount of gaseous fuel relative to oxygen in the feed to said combustion zone when said resulting voltage is above the set point, and increasing the amount of gaseous fuel relative to oxygen in said feed when said resulting voltage is below the set point.

12. Method according to claim 5 wherein said engine or turbine is driven at substantially constant load.

13. Method according to claim 7 wherein said generator is coupled to an existing electrical system.

* * * * *